US006402005B1

(12) United States Patent
Hüttelmaier et al.

(10) Patent No.: US 6,402,005 B1
(45) Date of Patent: Jun. 11, 2002

(54) PROCESS AND DEVICE FOR HANDLING A MATERIAL WEB

(75) Inventors: Günther Hüttelmaier, Heidenheim; Jürgen Birk, Sand am Main; Reinhard Faix, Giengen, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/427,442

(22) Filed: Nov. 8, 1999

(30) Foreign Application Priority Data

Nov. 9, 1998 (DE) ..... 198 51 593

(51) Int. Cl.[7] ..... B65H 26/00; B65G 43/00

(52) U.S. Cl. ..... 226/23; 226/45; 162/257; 198/810.03

(58) Field of Search ..... 226/21, 22, 23, 226/45; 198/806, 810.02, 810.03; 162/256, 257

(56) References Cited

U.S. PATENT DOCUMENTS

| | | | | |
|---|---|---|---|---|
| 2,842,361 A | * | 7/1958 | Miller | 226/21 |
| 2,877,013 A | * | 3/1959 | Wendshuh et al. | 226/23 |
| 3,079,805 A | * | 3/1963 | Rojecki | 226/23 X |
| 3,184,374 A | * | 5/1965 | Pearson | 162/257 |
| 3,225,988 A | * | 12/1965 | Drenning | 226/19 |
| 3,785,542 A | | 1/1974 | Edes et al. | |
| 3,908,880 A | * | 9/1975 | Russmann et al. | 226/22 X |
| 4,077,834 A | | 3/1978 | Stark | |
| 4,209,118 A | * | 6/1980 | Minton | 226/21 |
| 4,598,849 A | * | 7/1986 | Frye et al. | 226/21 |
| 4,606,486 A | * | 8/1986 | Brunner et al. | 226/21 X |

(List continued on next page.)

FOREIGN PATENT DOCUMENTS

| | | |
|---|---|---|
| DE | 2540923 | 3/1977 |
| DE | 3735202 | 4/1989 |
| DE | 3934241 | 5/1990 |
| DE | 4011796 | 10/1991 |
| DE | 4301651 | 12/1993 |
| EP | 607584 | 7/1994 |

OTHER PUBLICATIONS

*HDU Autoguide Assembly, Paper and Board Machine Clothing Always Under Control, Product Information*, Voith Sulzer Paper Technology (Apr. 1999).

Bandlaufregler HDU6, Voith Sulzer Paper Technology (Sep. 15, 1999), with English language translation.

*Primary Examiner*—Michael R. Mansen
(74) *Attorney, Agent, or Firm*—Greenblum & Bernstein, P.L.C.

(57) ABSTRACT

Process and device for handling a material web. The process includes moving the material web, at least in stretches, along with at least one circulating endless belt in a circulation direction and monitoring the movement of the edge of the at least one circulating endless belt. The process further includes driving repeatedly the circulating endless belt in a direction generally transverse to the circulation direction. The device includes at least one circulating endless belt for moving the material web along, at least in stretches, in a circular direction, and a master control unit for determining the transverse movement of the circulating endless belt. Additionally, the device includes at least one belt travel sensor for monitoring the position of the at least one circulating endless belt and repeatedly moving, in cooperation with the master control unit, the at least one circulating endless belt generally transverse to the circulation direction, and an activation device, for moving the sensor. The device further includes an associated control device, further comprising a pressure regulator and associated motorized adjustment device, for actuating the activation device. Sensor signals are generated by the at least one belt travel sensor, the signals being fed to the master control unit for determining the transverse movement of the at least one circulating endless belt.

20 Claims, 2 Drawing Sheets

U.S. PATENT DOCUMENTS 4,655,378 A 4/1987 DuFour
4,666,073 A * 5/1987 DuFour ..... 226/23
4,848,632 A * 7/1989 Mack et al. ..... 226/21 X
4,966,653 A 10/1990 Rantala et al.
5,328,072 A 7/1994 Ruessmann et al.
5,614,063 A 3/1997 Graf et al.
5,643,416 A * 7/1997 Lange et al. ..... 162/257 X
5,664,738 A * 9/1997 Fife ..... 226/23 X

* cited by examiner

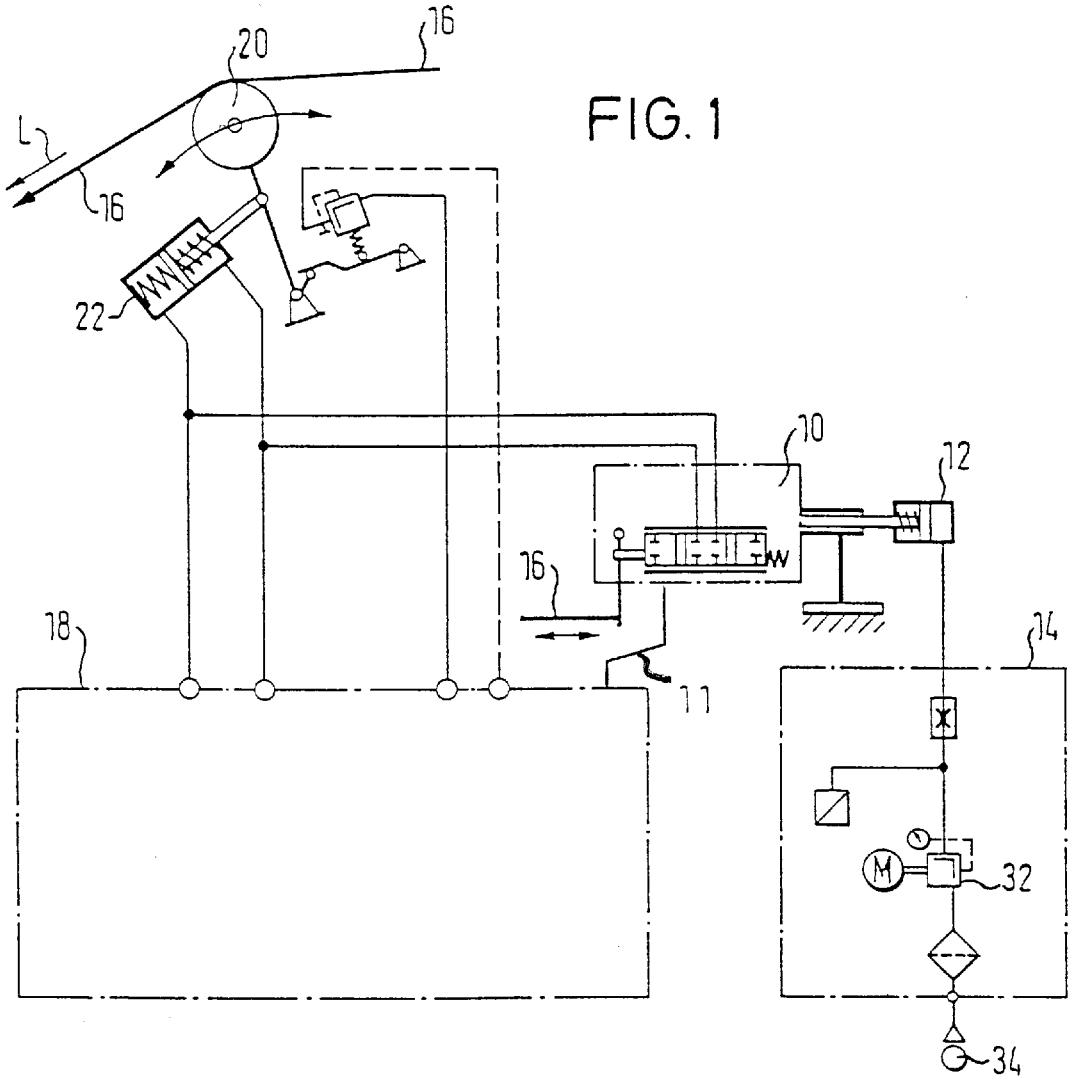
FIG. 1
FIG. 3
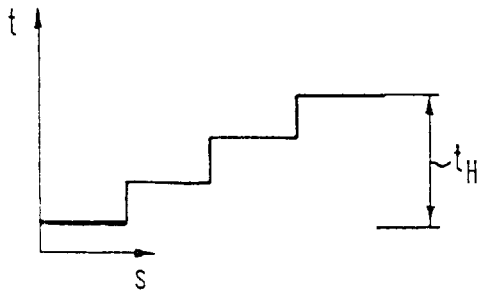
FIG. 4
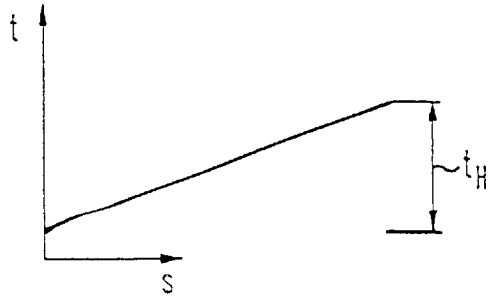

PROCESS AND DEVICE FOR HANDLING A MATERIAL WEB

CROSS-REFERENCE TO RELATED APPLICATIONS

The present application claims priority under 35 U.S.C. §119 of German Patent Application No. 198 51 593.6, filed Nov. 9, 1998, the disclosure of which is expressly incorporated by reference herein in its entirety.

BACKGROUND OF THE INVENTION

1. Field of the Invention

The invention concerns a process for handling a material web, such as a paper or cardboard web, in which the material web is moved at least in stretches with at least one continuous circulating belt, such as a wire or a felt belt, in a direction of circulation.

2. Discussion of Background Information

In the wire and/or press section of a paper machine, premature wear may occur on or near the edges of the circulating wire or felt belts used therein. Similarly, marking and soiling occur on the wire or felt belts which results in a short service live.

In a wet press known from DE 43 01 651 C1, the path of the belt is repeatedly extended and/or shortened on one outer edge relative to the other outer edge.

In a belt positioning arrangement known from DE 37 35 202 A1, continuous position detection for controlling the edges of moving webs, e.g., paper webs, drying felts, wires, or the like, is accomplished by continuously moving a position sensor along a circular path crossing the respective web edge twice.

In a paper machine known from U.S. Pat. No. 5,614,063, deviations in movement transverse to the circulation direction of an endless belt are detected by edge detectors, which emanate signals used to move the circulating belt back into its proper position, when necessary.

In an arrangement for guiding a continuous felt known from DE 40 11 796 A1, the belt is guided by a repeatedly inclined compensator roller and a regulating roller, both of which are automatically pivoted such that a monitored edge of the belt remains in a pre-specified plane. The belt is also braced, on its two edges, by the compensator roller.

The disclosures of the aforementioned patents are expressly incorporated by reference herein in their entirety.

SUMMARY OF THE INVENTION

The invention disclosed herein improves the process as well as the type of device described in the introduction by virtually eliminating markings and soiling in and around the edge of an endless belt, which results in longer belt service lives.

Specifically, this is done by repeatedly moving an endless belt generally transverse to the direction of circulation. Preferably, the belt is moved only periodically in the transverse direction.

The present invention may be embodied in three ways. Transverse movement of the endless belt may be effectuated solely by the control device or solely by the master control unit, or the traverse movement may be effectuated by the control device and the master control unit in cooperation.

In an embodiment of the process according to the invention wherein the control device and the master control unit cooperate, a belt travel sensor monitors the position of the belt, and, when necessary, the belt is adjusted accordingly in the transverse direction. To adjust the belt's position, sensor signals generated by the belt travel sensor are fed to a master control unit which controls the transverse movement of the belt.

In this invention, the belt travel sensor, which monitors the belt edges, may be a belt travel feeler or the like.

Further, the belt may be moved stepwise in the transverse direction. In certain applications, however, it is preferable for the belt to be moved continuously in the transverse direction.

According to an embodiment of the invention, the belt travel sensor may be driven in a linear manner, thereby causing the transverse movement of the belt, by an activation device which is controlled by an associated control device.

In the invention disclosed herein, the activation device can include at least one cylinder/piston unit. The cylinder/piston unit operates in only one direction and has a spring reset.

The distance of the transverse movement of the belt is preferably adjustable. Additionally, the travel time of the transverse movement of the belt may also be adjustable.

In an embodiment of the device according to the invention, the control device associated with the activation device includes at least one pressure regulator with a motorized adjustment.

The belt travel sensor may also be a pendulum feeler or the like.

The belt may be a wire or a felt belt. The invention is thus applicable both in the wire and in the press section of a respective paper making machine. It is also possible for a plurality of wire or felt belts to be moved transverse to the direction of circulation.

According to the invention, there is disclosed a process for handling a material web. The process includes moving the material web, at least in stretches, along with at least one circulating endless belt in a circulation direction and monitoring the movement of the edge of the at least one circulating endless belt. The process further includes driving repeatedly the circulating endless belt in a direction generally transverse to the circulation direction.

In the process disclosed herein, the belt may be either one of a wire belt or a felt belt, and the material web may be one of paper or cardboard.

Additionally, the at least one circulating endless belt can be moved periodically in the transverse direction.

According to the invention, the process further includes monitoring the position of the at least one circulating endless belt in the transverse direction by way of a belt travel sensor and driving the at least one circulating endless belt in the transverse direction to generate linear transverse movement of the at least one circulating endless belt.

The belt travel sensor may also be a belt travel feeler. In the invention, the belt travel sensor can be used for belt edge detection.

Additionally, the monitored position of the at least one circulating endless belt is fed to a master control unit for controlling the transverse movement of the at least one circulating endless belt.

With respect to movement of the circulating endless belt, it may be either moved stepwise in the transverse direction, or it can be moved continuously in the transverse direction.

According to the invention, the process further includes the at least one circulating endless belt being driven in the transverse direction, the magnitude of which is determined by the actuation device and the associated control device acting together. Additionally, the process includes the at least one circulating endless belt being driven in the transverse direction, the movement magnitude of which is determined solely by the master control device. Further, the process includes the at least one circulating endless belt being driven in the transverse direction, the movement magnitude of which is determined by a master control device in cooperation with an actuation device and an associated control device.

According to the invention, there is provided a device for handling a material web is provided. The device includes at least one circulating endless belt for moving the material web along, at least in stretches, in a circular direction, and at least one belt travel sensor for monitoring the position of the at least one circulating endless belt and repeatedly moving the at least one circulating endless belt generally transverse to the circulation direction. The invention further includes an activation device, for moving the sensor and an associated control device, for actuating the activation device.

In the device disclosed herein, the material web may be either one of paper or cardboard.

In the invention, the at least one belt travel sensor is provided for moving the at least one continuous belt periodically in the transverse direction. The device further includes a master control unit, which cooperates with the at least one belt travel sensor, which monitors the position of the at least one circulating endless belt in the transverse direction, to drive the at least one circulating endless belt in the transverse direction.

According to the invention, the magnitude of the transverse movement of the endless circulating belt is determined by cooperation between the activation device for moving the sensor and the associated control device for actuating the activation device.

In the device disclosed herein, sensor signals are generated by the at least one belt travel sensor, the signals being fed to the master control unit for determining the transverse movement of the at least one circulating endless belt. Alternatively, the master control unit may cooperate with the activation device for moving the sensor and the associated control device for actuating the activation device to generate the transverse movement of the circulating endless belt.

Additionally, the device includes a distance adjustment mechanism for adjusting the distance of the traverse movement of the at least one circulating endless belt, and a time adjustment mechanism for adjusting the travel time of the traverse movement of the at least one circulating endless belt. The mechanisms may move the at least one circulating endless belt stepwise in the transverse direction, or it may be moved continuously in the transverse direction.

In the present invention, the at least one belt travel sensor may be a belt travel feeler, and the at least one belt travel sensor monitors the location of the edge of the circulating endless belt. Further, the at least one belt travel sensor may be a pendulum feeler.

According to the invention, the associated control device includes a pressure regulator and a motorized adjustment device for the regulator. The pressure may be either hydraulic or pneumatic.

In the device disclosed herein, the activation device, which includes at least one cylinder/piston unit, moves the at least one belt travel sensor linearly. Additionally, the at least one cylinder/piston unit includes a piston acting in one direction and a spring reset for acting in the other direction.

According to the invention described herein, there is disclosed a device for handling a material web. The device includes at least one circulating endless belt for moving the material web along, at least in stretches, in a circular direction, and a master control unit for determining the transverse movement of the circulating endless belt. Additionally, the device includes at least one belt travel sensor for monitoring the position of the at least one circulating endless belt and repeatedly moving, in cooperation with the master control unit, the at least one circulating endless belt generally transverse to the circulation direction, and an activation device, for moving the sensor. The device further includes an associated control device, further comprising a pressure regulator and associated motorized adjustment device, for actuating the activation device. In the invention, sensor signals are generated by the at least one belt travel sensor, the signals being fed to the master control unit for determining the transverse movement of the at least one circulating endless belt.

Examples of a pendulum feeler and cylinder/piston unit are described in the *HDU Autoguide Assembly, Paper and Board Machine Clothing Always under control, Product Information,* VOITH SULZER PAPER TECHNOLOGY (April; 1999)(in English), which is incorporated herein by reference. Additional details are described in Bandlaufregler HDU6, VOITH SULZER PAPER TECHNOLOGY, (Sep. 15, 1999), which is incorporated herein by reference.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of embodiments of the present invention, in which like reference numerals represent similar parts throughout the several views of the drawings, and wherein:

FIG. 1 is a schematic depiction of an activation device, a belt travel sensor, a control device, and a master control unit which receives the sensor signals and therefrom determines the transverse movement of the belt;

FIG. 3 is a diagram depicting the stepwise movement of the belt travel sensor; and FIG. 4 is a diagram depicting the continuous movement of the belt travel sensor.

DETAILED DESCRIPTION OF THE PRESENT INVENTION

Figure 2:
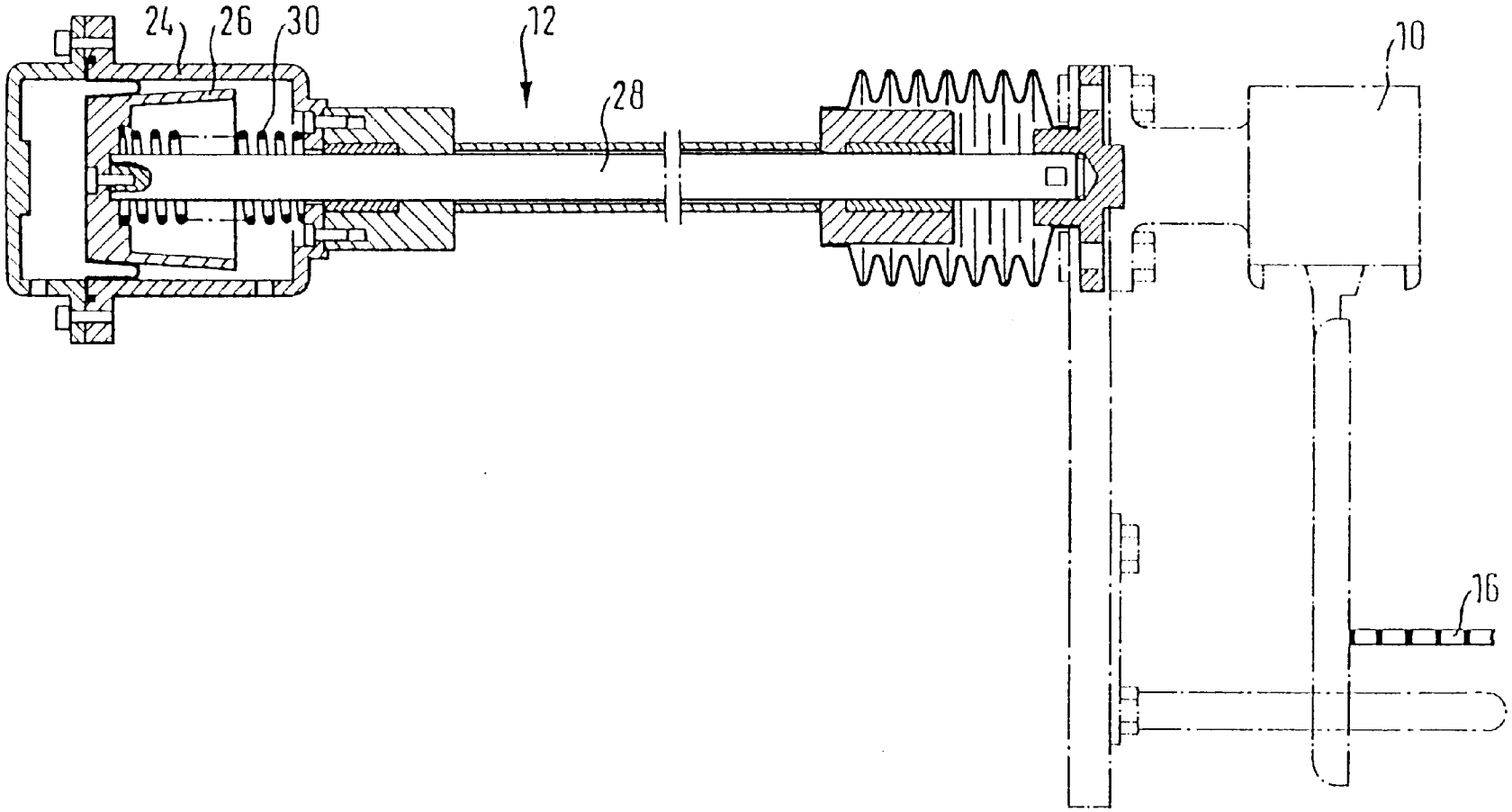
FIG. 2 is an enlarged schematic depiction of the activation device and associated belt travel sensor.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

FIG. 1 is a representation of an activation device 12, acting on a belt travel sensor 10, with an associated control device 14 as well as a master control unit 18 which receives the sensor signals via line 11 and therefrom determines the transverse movement of a circulating endless belt 16.

The endless belt 16 may be a wire or felt belt incorporated into a device for handling a material web, such as a paper or cardboard web. In such a paper machine, the material web to be handled is moved at least in stretches along with the circulating endless belt 16 in its circulation direction L.

The endless belt 16 is moved not only in the circulation direction L, but periodically also generally transverse to the circulation direction L. In the present case, this transverse movement is caused by-a regulating roller 20, which is acted upon, for this purpose, by at least one cylinder/piston unit 22 which is controlled by the control unit 18. As is discernible from FIG. 1, a cylinder/piston unit 22 having a reset spring and operating in only one direction is employed.

The linear transverse movement of the belt 16, in the present case, is a result of the belt travel sensor 10, which is monitoring the position of the belt 16 in the transverse direction, being driven in the transverse direction by an associated activation device 12.

In the present embodiment, a pendulum feeler, used to detect the belt edge, is utilized as a belt travel sensor 10 (see also, in particular, FIG. 2).

As is best discernible from FIG. 2, the activation device 12 includes at least one cylinder/piston unit, having a spring reset, which operates in only one direction. In the present case, the piston 26, which is located in the cylinder 24, is loaded toward the left of the endless belt 16 by a pressure spring 30, which is located in the right pressure chamber of the cylinder 24 and which pushes against the piston rod 28. When necessary to move the belt, pressure is exerted in the left pressure chamber of the cylinder 24, which causes the piston 26 and the piston rod 28 to be pushed against the spring force towards the endless belt 16. Additionally, the outer free end of the piston rod 28 is connected to a belt travel sensor 10 embodied as a pendulum feeler, in the instant case.

Further, the belt travel sensor 10 which is monitoring the position of the belt 16 in the transverse direction is driven, thus causing the belt 16 to move transversely, by the associated control device 14. For this purpose, the control device 14 which is associated with the activating device 12 includes a pressure regulator 32 with motorized adjustment.

In the present invention, the distance of the transverse movement of the belt 16 is adjustable. Additionally, the travel time of the transverse movement of the belt 16 can also be adjustable.

The belt 16 can be moved in steps or continuously, in the transverse direction.

In each of the two diagrams depicted in FIGS. 3 and 4, the time 't' is represented over the path 's' traveled by the belt travel sensor 10 during one stroke. FIG. 3 depicts a diagram of a stepwise movement of the belt travel sensor 10 during one stroke. The adjustable travel time $t_H$ can, for example, be 30 minutes. The time indicated applies to one stroke.

FIG. 4 depicts a diagram of a continuous movement of the belt travel sensor 10 during one stroke.

In principle, however, other adjustments are also possible.

As is also discernible from FIG. 1, the control device 14 which is associated with the activation device 12 is connected to a pressure source 34. The pressure source 34 may provide either hydraulic or pneumatic pressure. Consequently, the control device 14 may be operated by hydraulic or pneumatic pressure.

In sum, the belt travel sensor 10 used for belt edge detection is adjusted linearly by an activation device 12, which is actuated by a control device 14 which includes a pressure regulator 32 with motorized adjustment. The travel distance and/or the travel time is also adjustable. Due to the control device 14, the belt travel sensor 10 is very accurately and precisely driven for a pre-programmable time, which results in the continuous belt 16 executing a uniform, controlled, and continuous movement, reliably avoiding coating of the belt edges. Further the belt 16 may be a wire or a felt belt of a paper machine. Thus, the belt 16 may be a pickup felt or the like.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

10 belt travel sensor
12 activation device
14 control device
16 endless belt
18 control unit
20 regulating roller
22 cylinder/piston unit
24 cylinder
26 piston
28 piston rod
30 pressure spring
32 pressure regulator
34 pressure source

What is claimed:

1. A device for handling a material web comprising:

at least one circulating endless belt for moving the material web along in a circulation direction;

at least one belt travel sensor for monitoring the position of said at least one circulating endless belt, the at least one belt travel sensor being utilized in periodically moving said at least one circulating endless belt generally transverse to said circulation direction;

a belt moving device;

the at least one belt travel sensor having a belt engaging surface which engages an edge of said at least one circulating endless belt;

an activation device for moving the belt travel sensor; and an associated control device for actuating said activation device, wherein the at least one belt travel sensor is utilized to cause the belt moving device to move the at least one circulating endless belt transversely.

2. The device recited in claim 1, wherein said material web is one of paper or cardboard.

3. The device recited in claim 1, wherein said activation device for moving the at least one belt travel sensor and the associated control device for actuating the activation device cooperate to generate the transverse movement of said at least one circulating endless belt.

4. The device recited in claim 1, further comprising a master control unit, and wherein said at least one belt travel sensor monitors the position of said at least one circulating endless belt in the transverse direction and cooperates with said master control unit to cause the belt moving device to move said at least one circulating endless belt in the transverse direction.

5. The device recited in claim 4, wherein sensor signals are generated by said at least one belt travel sensor, the signals being fed to said master control unit for determining the transverse movement of said at least one circulating endless belt.

6. The device recited in claim 4, wherein said activation device for moving the sensor and the associated control device for actuating the activation device cooperate with said master control unit to generate the transverse movement of said at least one circulating endless belt.

7. The device recited in claim 1, wherein a distance of the traverse movement of said at least one circulating endless belt is adjustable.

8. The device recited in claim 1, wherein the travel time of the traverse movement of said at least one circulating endless belt is adjustable.

9. The device recited in claim 1, wherein said at least one circulating endless belt is moved stepwise in the transverse direction.

10. The device recited in claim 1, wherein said at least one circulating endless belt is moved continuously in the transverse direction.

11. The device recited in claim 1, wherein said at least one belt travel sensor comprises a belt travel feeler.

12. The device recited in claim 1, wherein said at least one belt travel sensor monitors the location of the edge of said at least one circulating endless belt.

13. The device recited in claim 1, wherein said at least one belt travel sensor comprises a pendulum feeler.

14. The device recited in claim 1, wherein said associated control device further comprises a pressure regulator and a motorized adjustment device for the regulator.

15. The device recited in claim 1, wherein said activation device moves said at least one belt travel sensor linearly.

16. The device recited in claim 1, wherein said activation device comprises at least one cylinder/piston unit.

17. The device recited in claim 16, wherein said at least one cylinder/piston unit comprises a piston acting in one direction and a spring reset for acting in the other direction.

18. The device according to claim 1, wherein said at least one circulating endless belt is moved in a stepwise manner in the transverse direction as a measure to prevent premature wear on or near edges of the at least one circulating endless belt.

19. A device for handling a material web comprising:

at least one circulating endless belt for moving the material web along in a circulation direction;

a belt moving device;

a master control unit for determining a transverse movement of said at least one circulating endless belt;

at least one belt travel sensor for monitoring the position of said at least one circulating endless belt and being utilized to cause the belt moving device to repeatedly move, in cooperation with said master control unit, said at least one circulating endless belt generally transverse to said circulation direction;

the at least one belt travel sensor having a belt engaging surface which engages an edge of said at least one circulating endless belt;

an activation device for moving the sensor; and an associated control device, further comprising a pressure regulator and associated motorized adjustment device, for actuating said activation device, wherein, sensor signals are generated by said at least one belt travel sensor, the signals being fed to said master control unit for determining, in cooperation with said activation device and said associated control device, the transverse movement of said at least one circulating endless belt.

20. A device for handling a material web comprising:

at least one circulating endless belt for moving the material web along in a circulation direction;

a belt moving device;

at least one belt travel sensor for monitoring the position of said at least one circulating endless belt and being utilized to cause the belt moving device to continuously move said at least one circulating endless belt generally transverse to said circulation direction;

the at least one belt travel sensor having a belt engaging surface which engages an edge of said at least one circulating endless belt;

an activation device for moving the belt travel sensor; and an associated control device for actuating said activation device, wherein said at least one circulating endless belt is continuously moved in the transverse direction as a measure to prevent premature wear on or near edges of the circulating endless belt.

* * * * *